United States Patent [19]

Hesse

[11] Patent Number: 4,826,076

[45] Date of Patent: May 2, 1989

[54] DEVICE FOR THE SUPPORT OF DRIVING TRACKS FOR TOY VEHICLES

[76] Inventor: Kurt Hesse, Waldstrasse 36, D-8510 Fürth, Fed. Rep. of Germany

[21] Appl. No.: 116,571

[22] PCT Filed: Dec. 8, 1986

[86] PCT No.: PCT/DE86/00501

§ 371 Date: Sep. 17, 1987

§ 102(e) Date: Sep. 17, 1987

[87] PCT Pub. No.: WO87/04364

PCT Pub. Date: Jul. 30, 1987

[30] Foreign Application Priority Data

Jan. 28, 1986 [DE] Fed. Rep. of Germany ..... 3602382
Nov. 27, 1986 [DE] Fed. Rep. of Germany ..... 3640492

[51] Int. Cl.[4] ..... A63H 18/02

[52] U.S. Cl. ..... 238/10 R; 238/10 A; 104/124; 104/125; 104/126; 446/117

[58] Field of Search ..... 403/71, 194, 195, 359; 104/125, 126, 124, DIG. 1, 305; 238/10 A, 10 R, 10 E, 10 F; 446/127, 117, 120, 105, 124, 71

[56] References Cited

U.S. PATENT DOCUMENTS

D. 214,745 7/1969 Walker ..... 446/127 X
1,252,616 1/1918 Reif ..... 446/124
3,225,487 12/1965 Mallaliew ..... 446/127
3,624,954 12/1971 Veken ..... 446/71
3,861,812 1/1975 Ito ..... 403/71
4,352,329 10/1982 Fetty et al. ..... 104/305

FOREIGN PATENT DOCUMENTS 1348517 12/1963 France .
2078120 1/1982 United Kingdom ..... 238/10 F

*Primary Examiner*—Andres Kashnikow
*Assistant Examiner*—Mark T. Le
*Attorney, Agent, or Firm*—Collard, Roe & Galgano

[57] ABSTRACT

A device for the support of driving tracks for toy vehicles, in particular driving tracks consisting of track segments which are plugged together and which have a center section laterally bounded by guiding elements. The center section of each track segment is designed to be a road surface forming driving lanes which are spaced above set-up surfaces. Provision is made for the support of track segments on any desired level by an arrangement comprising an upright column designed for connection with a base plate by use of a male and female plug system and consisting of upright column segments. Such segments are axially and detachably plugged into each other one on top of the other and have support arms. These arms are suspendable on such segments of the upright column in prepared holes or are symmetrically supportable on the free end of the upright column by means of a sleeve part. Furthermore, guiding bodies are formed on the top side of the supporting arms serving to attach segments of the trackway on the supporting arms.

22 Claims, 2 Drawing Sheets

DEVICE FOR THE SUPPORT OF DRIVING TRACKS FOR TOY VEHICLES

BACKGROUND OF THE INVENTION

The invention relates to a device for supporting driving tracks for toy vehicles, in particular tracks consisting of trackway segments which are plugged together and have a center section laterally bounded by guiding elements of predetermined shape and forming driving lanes designed to be driven on which are spaced above the surfaces on which such trackways are set up.

It is known to promote the desire for playing with track-bound toy vehicles by extending the driving tracks or driving track segments with a spacing above the surface on which the trackway is set up. For this purpose, the driving tracks or driving track segments have to be supported by supporting elements, for example building blocks supporting such tracks or track segments above the surface with suitable spacings. It is understood that this type of support for the trackway segments leads only to unstable trackways, which has an adverse effect on the desire to play with such toys. Furthermore, such supports can be adjusted in height only in a complicated manner.

SUMMARY OF THE INVENTION

The objective of the invention is to support driving track segments in such a way that their height or level and extension above the set-up surface can be varied in any desired manner.

According to the invention, this objective is accomplished by the arrangement of an upright column, which is connected by plugging with a base plate and consists of upright column segments, which are axially and detachably plugged into each other and which have supporting arms suspendable in prepared holes or symmetrically supportable on the free end of the upright column by means of a sleeve part, with guiding means formed on the top side of the supporting arms for fixing the segments of the trackway. The upright column segments, of which any desired number can be plugged together, permit the formation of a more or less high device which, by means of the plugged-on supporting arms, is capable of supporting in a stable manner trackway segments selectively in a straight line or in the curved form in the manner of ramps.

Preferably, the holes are formed in the same planes of the upright column segments and one hole is provided in each side surface of the upright column segments. In this way, individual or several driving tracks can be extended next to one another or one on top of the other lengthwise or crosswise by plugging the supporting arms as required for such configurations. Furthermore, the holes create the condition permitting the support of the supporting arms by two upright columns set up parallel next to each other, or to attach to the upright column segments two or more supporting arms at the same time in a cantilever-type of construction or set-up.

Preferably the segments of the upright column have the shape of a pot and are provided in the circumferential surface of the closed end with an outside groove for receiving by plugging the marginal surface enclosing the open side of an adjacent segment of the upright column. The connection between the segments of the upright column can be effected by friction grip, so that the disconnection of the plug connection requires simple pulling apart only. Also, locking elements may be conceivably arranged in the common surfaces of separation of plugged segments of the upright column, which locking elements, when overcome, permit a separation of the segments of the upright column. The arrangement of such click-stops leads to a particularly stable and also transportable upright column.

The segments of the upright column, of course, may have any desired cross sectional form as hollow or solid bodies. According to a preferred embodiment, the segments of the upright column have a square cross section and rounded corner zones. It is in conformity with the nature of the present invention that the segments of the upright column may have the same axial lengths or different axial lengths.

A particularly safe set-up of the upright column can be accomplished if the segments of the upright column or the upright columns can be detachably plugged with their open sides into a socket attachment rigidly arranged on the base plate. Preferably, the base plate has a square cross section. However, the base plate may have any desired form, for example a circular shape.

According to another feature of the invention, the supporting arms may have in the center on the bottom side a sleeve part designed to be slipped into the groove extending all around the segment of the upright column, or into the socket attachment of the base plate. Such a sleeve part permits the symmetrical plugging of the supporting arms on the free ends of the segments of the upright column. Furthermore, provision is made that on the free ends, the supporting arms have U-shaped hook parts, which are pluggable into the holes of the segments of the upright column and supportable on boundary surfaces of the holes. In this way, the supporting arms can be supported with one end on the segments of the upright column, whereby the holes permit any desired fixation of the supporting arms, for example with limitation of a quarter, semi- or three-quarter circle. Also, on the free ends, the supporting arms may be fitted with prismatic guiding bodies pointing crosswise in the upward direction, such guiding bodies in turn having L-shaped hook parts, which are pluggable into the holes and which receive boundary surfaces of the holes for supporting the supporting arms between themselves and the guiding bodies.

Finally, for fixing the segment of the trackway on the supporting arms, provision is made that on the top side, the supporting arms have plug attachments, such attachments being rigidly connected with the supporting arms and pluggable into the guiding bodies of the segments of the trackway. Conceivably, the segments of the driving trackway may be fixed in such a way that the supporting arms are provided on the top side with strip parts bendable outwardly in a springy, elastic manner, such strip parts releasably gripping across the guiding bodies of a trackway segment of installed driving track segments with a hook-like attachment. Furthermore, a fixation of of the trackway segments on the supporting arms can be accomplished by fitting the supporting arms with extensions which, on the guiding bodies, grip across the guiding bodies of an installed trackway segment. The two last-mentioned embodiments permit limited movement of the trackway segment on the supporting arm both lengthwise and sideways, however, they make it impossible for the trackway segment to unintentionally lift from the supporting arm by knocking against the attachments or extensions.

It is in conformity with the idea of the invention that the base plate, the segments of the upright column and the supporting arms can be made of a thermoplastic material dyed in the same or different colors. The use of plastics creates the condition for a simple manufacture of the device or its parts, whereby coloration of the material supplies the user with an indication of defined lengths of the segments of the upright column.

As an additional feature of the supporting device, provision is made that the base plate has recesses and attachment along its circumferential surface serving as pluggable connection means for additional, identical base plates. In this way, support combination can be formed by combining any desired number of base plates so as to create a particularly stable support device. Usefully, the base plate has a hexagonal cross section, with a recess or an attachment serving as connecting means in each case being provided in diametrally opposed sections of the circumferential surface. In this connection, the recesses and attachment preferably have a dovetailed shape with identical widths increasing in the outward direction. Also, the recesses and attachments may have other forms of cross section, for example a T-shaped form.

According to another feature of the invention, the support device is formed with an upright column constructed from upright column segments with a cross section in the shape of a circular cylinder, such segments being combined with each other by plugging. Such segments of the upright column may have an identical length axially, or different axial lengths. Each of the segments of the upright column has an open and a closed face end, whereby each closed end has a notch within the zone of the circumferential surface to which the open end of an adjacent segment of the upright column or a supporting arm can be plugged.

Finally, for increasing the stability of the device, provision is made to plug to the upright column or segments of the upright column a molded part with a center section and a number of radially projecting arms, such molded part having plug attachments on the center section and on top of the arms for segments of the upright column, and recesses on the bottom side for receiving the ends of column segments averted from the notch. The center spacings of the plug attachments of the arms and center section are selected equal the center axis spacings of the plug attachments of base plates connected with one another by plugging. By means of the molded part, the free ends of upright columns plugged to the base plates can be fixed next to each other with concentric spacing, resulting in a particularly stable supporting device.

Furthermore, it was found to be advantageous if the segments of the upright column have several clamping strips at the ends having the notch, and the plug attachments of the base plate and molded part have such strips as well, the latter being displaced by the same degrees of angle. Such clamping strips are pressed to abut the interior circumferential surfaces of the open ends of plugged segments of the upright column. Moreover, the segments of the upright column and the molded part have holes for receiving by plugging the hook parts arranged on the supporting arms.

BRIEF DESCRIPTION OF THE DRAWINGS

The invention is explained in detail with the help of the embodiment shown in the drawing, in which.

DESCRIPTION OF THE PREFERRED EMBODIMENTS

Figure 1:
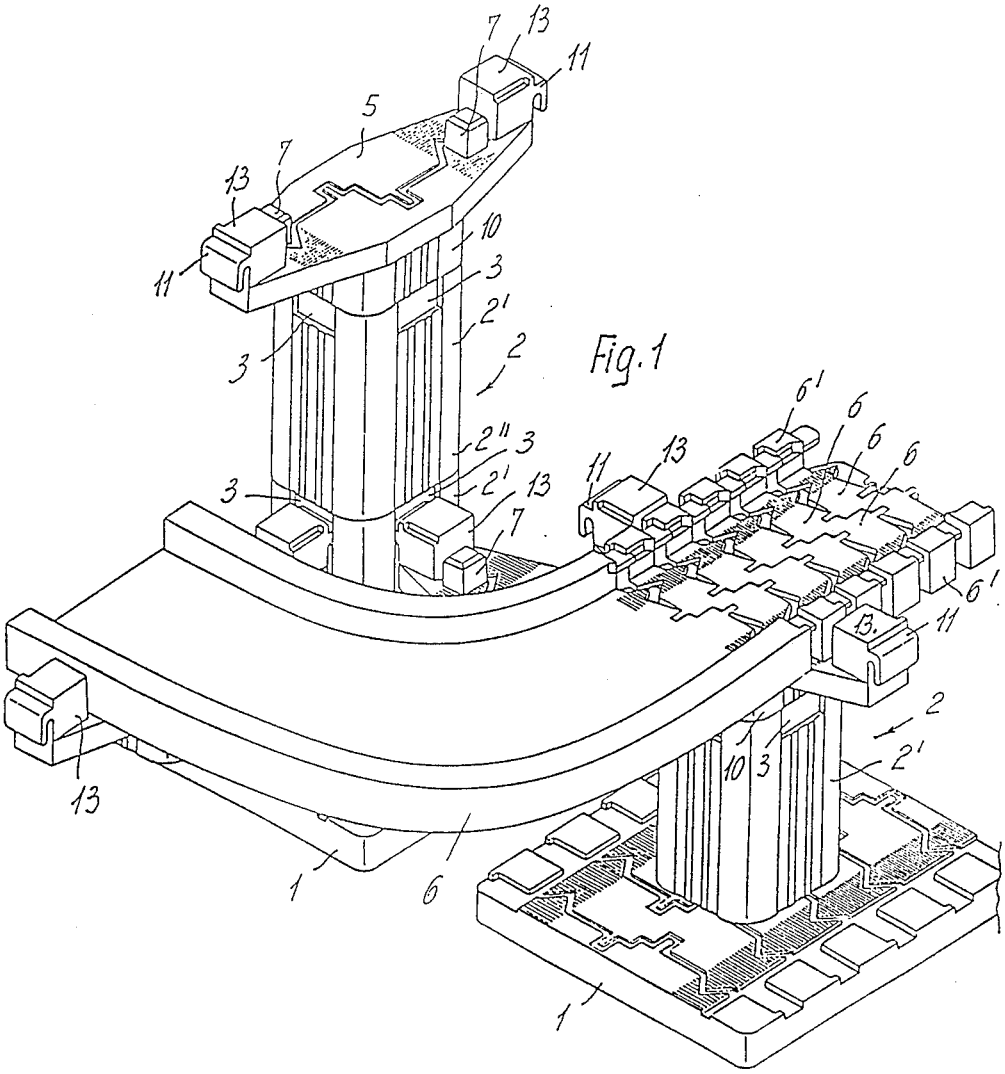
FIG. 1 is a perspective view of the device with a segment of the trackway placed on the device.
Figure 2:
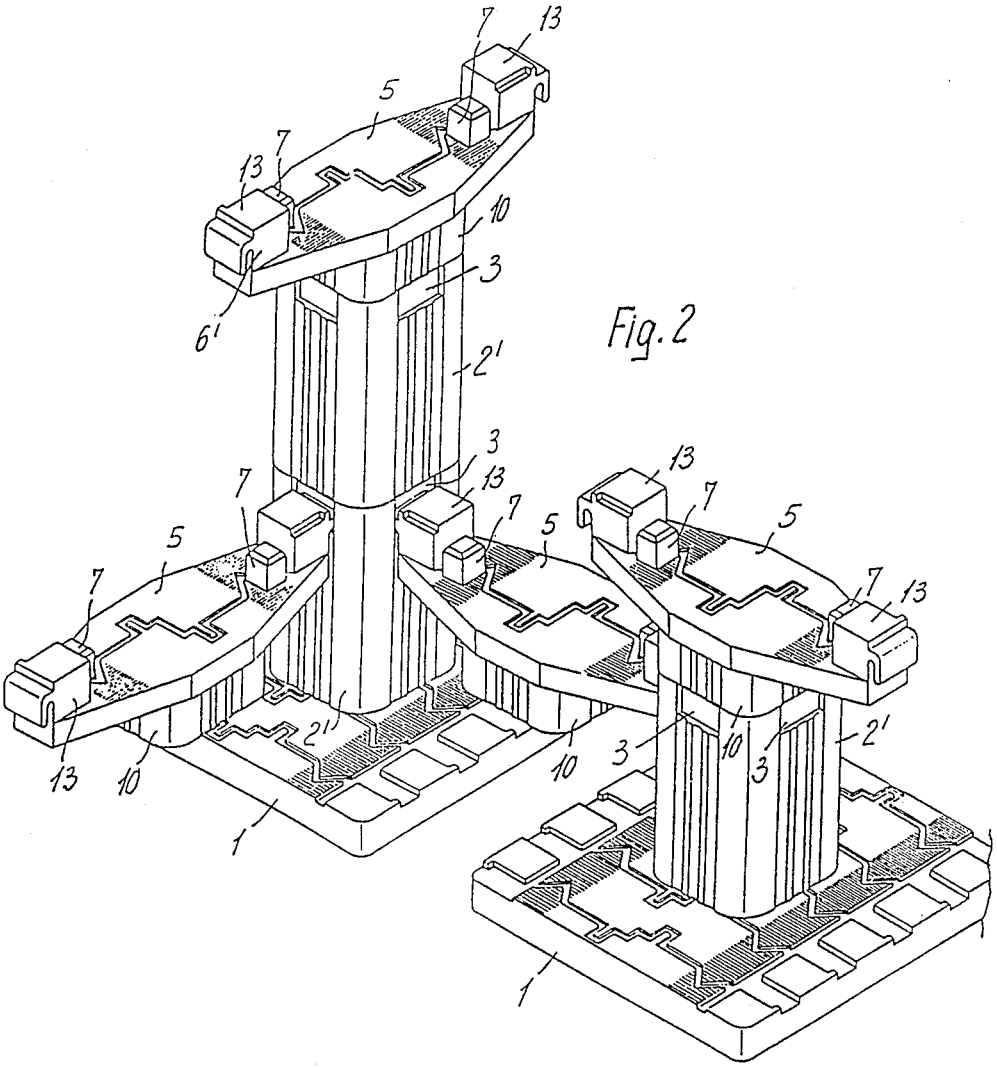
FIG. 2 is a perspective view of a device of the invention.
Figure 6:
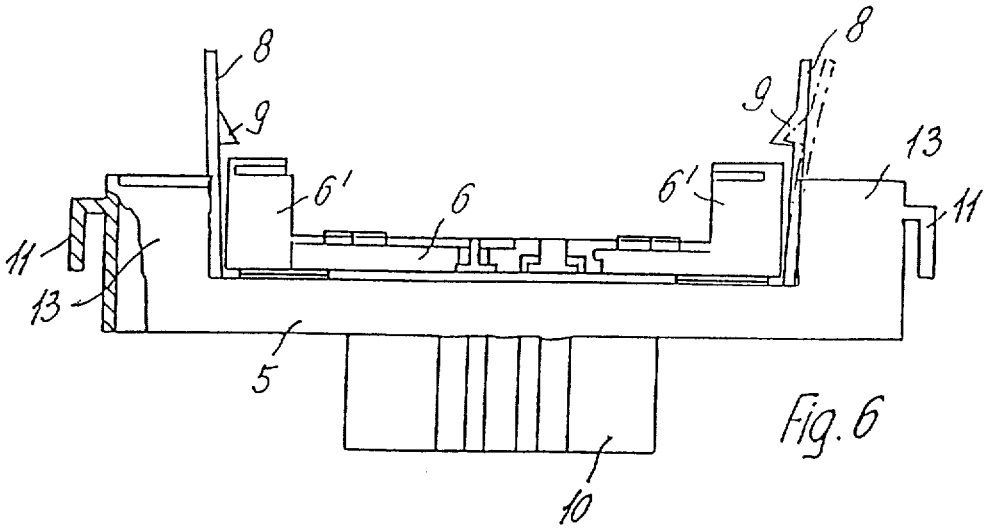
FIG. 6 shows a front view of another embodiment of a supporting arm partly shown sectionally.
Figure 7:
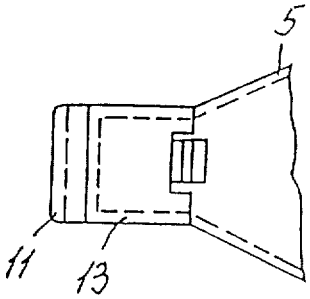
FIG. 7 is a top view of a part of FIG. 6.
Figure 8:
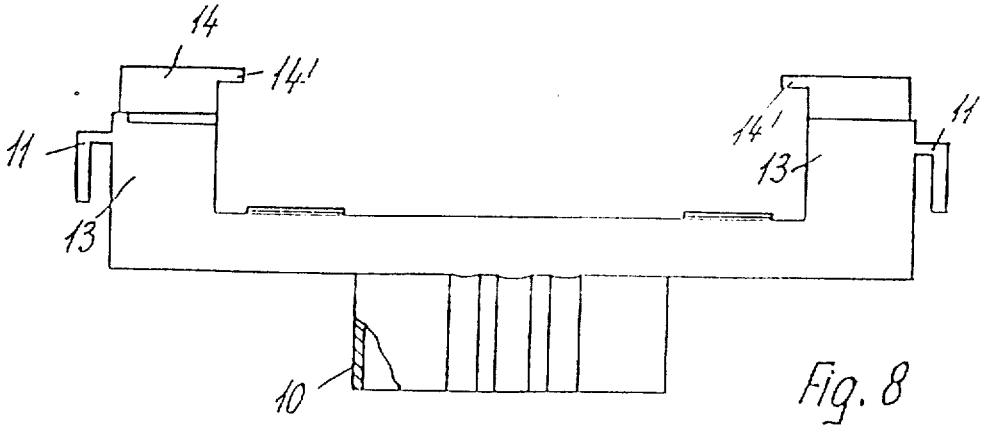
FIG. 8 shows another embodiment of a supporting arm partly shown sectionally.
Figure 4:
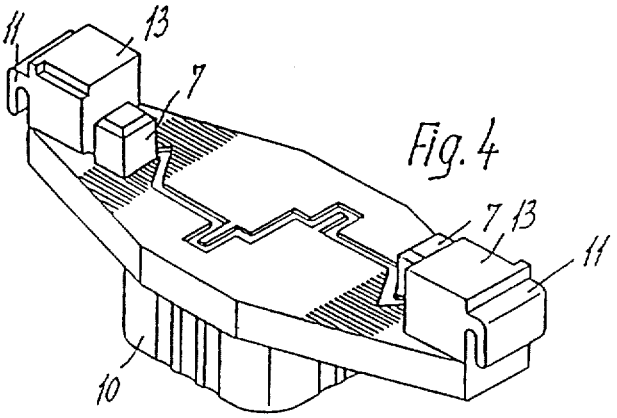
FIG. 4 shows a perspective view of a supporting arm.
Figure 5:
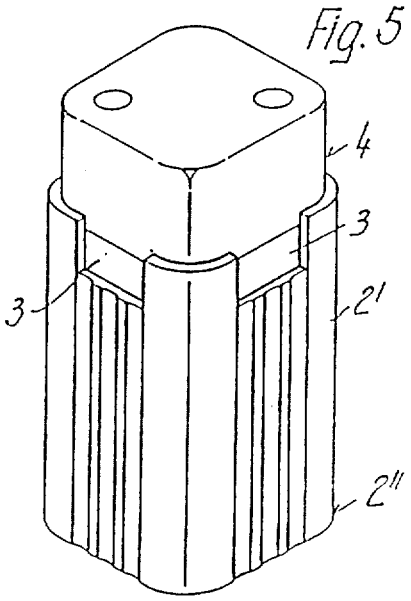
FIG. 5 is a perspective view of a segment of the upright column.
Figure 3:
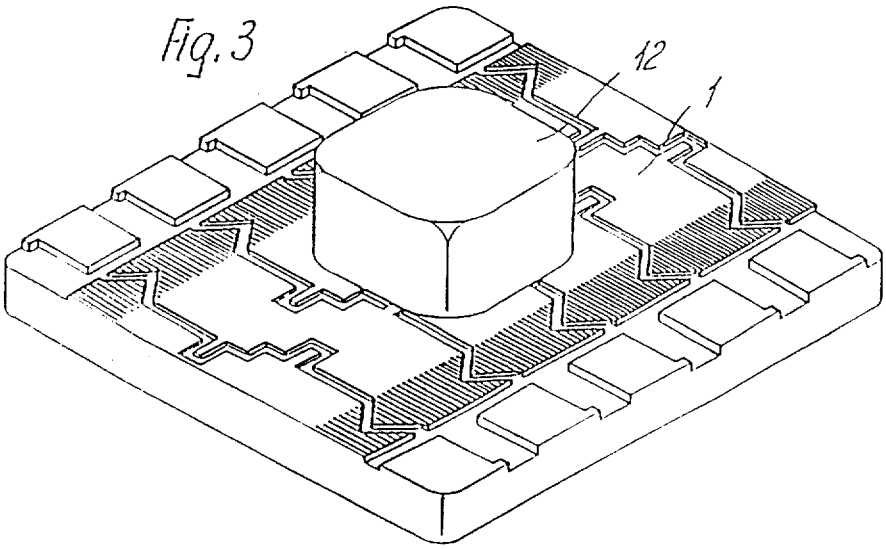
FIG. 3 is a perspective view of a base plate.

In FIGS. 1 to 3, reference numeral 1 denotes a base plate serving for the support of an upright column 2. The upright column 2 is formed by one or several plugged upright column segments 2' each having a hole 3 in each side surface. The segments 2' of the upright column are designed in the shape of a pot having a male and female end and have a notch 4 extending all around on the outside in the zone of their closed ends, such notch serving the purpose of receiving the marginal surfaces 2'' of the open female end of the pluggable upright column segments 2'. Usefully, the segments 2' are connected by friction grip, which assures a certain stable connection between the column segments 2'. The supporting arms 5 with the L-shaped or U-shaped moldings 11 formed on their free ends are pluggable into the holes 3. For such plugged connection, such moldings extend through the holes 3 and, by coming to rest on the boundary surfaces of the holes 3, provide support for the supporting arms 5. FIG. 1 shows that the segments of the trackway formed by the trackway pieces 6 can be extended across the supporting arms 5. Such segments 6 of the trackway may be loosely placed on the supporting arms 5 or fixed on the latter by means of the plug attachments 7 arranged on the supporting arms 5, such plug attachments engaging the guiding elements 6' of the trackway segments 6. FIG. 6 shows that it is possible to provide or fit the supporting arms with the strip parts 8, which are bendable down outwardly in a springy, elastic manner, and which grip with the attachments 9 across the segments 6 of the trackway in order to fix such segments. The trackway segments so secured remain displaceable lengthwise, however, they cannot unintentionally be lifted upwardly. Such lifting requires an outward deflection of the strip parts 8 (right side of FIG. 6). For fixing the segments 6 of the trackway, provision is made, furthermore, for the extensions 14 (FIG. 8) extending on the guiding bodies 13 of the supporting arms 5 upwardly and inwardly. Such extensions grip across the guiding elements 6' of the trackway segments 6 and hold the latter on the supporting arms 5.

By the plug sleeves 10 arranged in the center of the bottom side of the supporting arms 5, it is possible to detachably and symmetrically plug the supporting arms 5 to the trackway segments 2' or a male plug attachment 12 of the base plate 1. In FIGS. 1 and 2, two base plates 1 are equipped with different numbers of upright column segments 2' for the formation of two upright columns 2. The two upright columns are connected with one another by a supporting arm 5 which, for such connection, engages with its moldings 11 the holes 3 of the column segments 2', whereupon it is pushed down. Furthermore, the left upright column supports a supporting arm 5 projecting crosswise, and both upright columns 2 support the supporting arms 5 at their top ends by means of the plug sleeves 10. By the prismatic guiding bodies 13 pointing crosswise in the upward direction on the supporting arms 5, the segments 6 of the trackway are guided on the supporting arms 5 with clearance on both sides.

Figure 10:
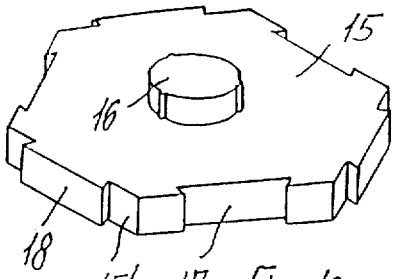
FIG. 10 is an enlarged perspective view of a base plate.
Figure 11:
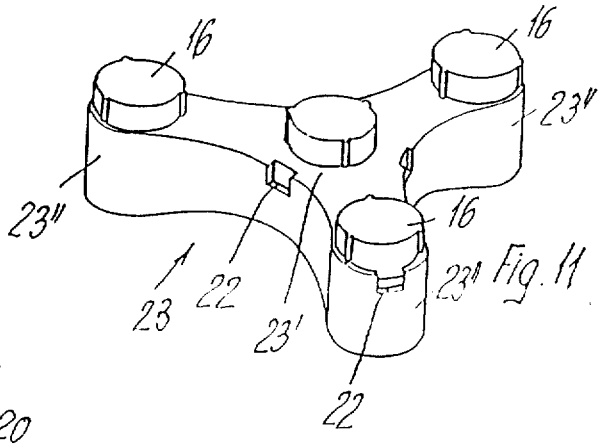
FIG. 11 is an enlarged perspective view of a molded part.
Figure 13:
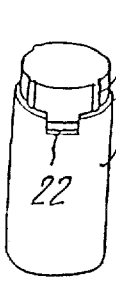
FIG. 13 is a perspective view of segments of the upright column of a first length.
Figure 14:
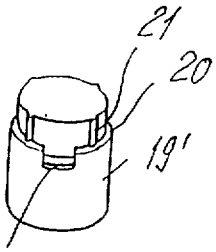
FIG. 14 is a perspective view of segments of the upright column of a different length from FIG. 13.
Figure 15:
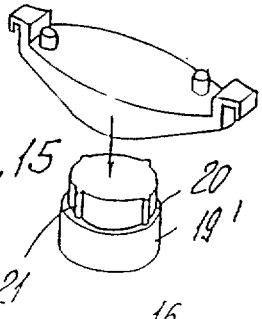
FIG. 15 is a perspective view of a supporting arm with a segment of the upright column.
Figure 12:
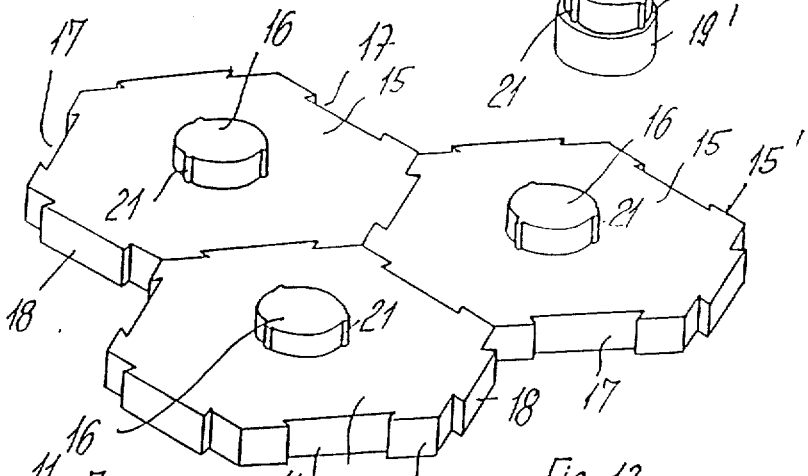
FIG. 12 is a perspective view of assembled base plates according to FIG. 2.
Figure 9:
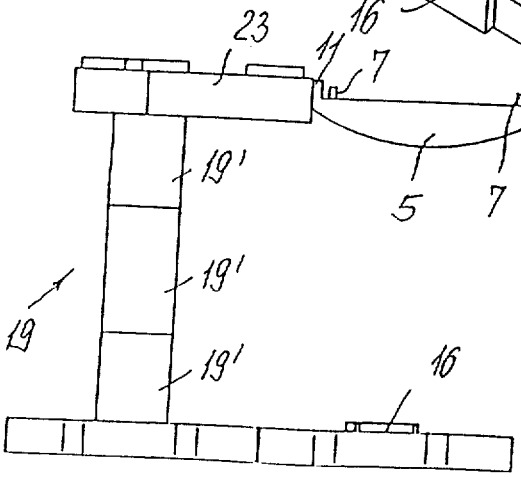
FIG. 9 is a lateral view of the supporting device.

In FIGS. 9 to 15, reference numeral 15 denotes a flat base plate which, according to FIGS. 10 and 12, has a hexagonal cross section and a male plug attachment 16 in the center. In the circumferential surface 15' of the base plate 15, the recesses 17 and the attachments 18 are formed in each case in diametrally opposed sections of the circumference, in a dovetailed form in the present embodiment. FIG. 12 shows that by pushing the attachments 18 into the recesses 17, any desired number of base plates 15 can be combined for setting up a support device combination. An upright column 19 can be plugged to each of the plug attachments 16 of the base plates 15, such upright column being formed by the column segments 19' according to FIGS. 13 and 14. Such segments 19' of the upright column have identical or different lengths and designed with a cylindrical cross section. They are provided with a closed face end supporting a step 20 into which the clamping strips 21 protrude. The segments 19' of the upright column is provided, furthermore, with the holes 22 for receiving the supporting arms 5 (FIG. 15), which are suspended in such holes. The supporting arms 15 have the hook parts 11 shaped by molding on the arms, which hook parts, on being inserted in the holes 22, support the supporting arms 5 on the segments 19' of the upright column. In addition, the supporting arms 5 receive on their top side the attachments 7 serving as guiding means, the latter fixing the segments of the trackway (not shown) on the supporting arms 5.

Of course, one single base plate 15 with one upright column 19 and one supporting arm 5 may form a supporting device. For setting up support combinations, FIG. 12 shows that several base plates 15 are assembled, each of such plates supporting an upright column 19. A molded part 23 (FIG. 11) can be plugged to the free ends of the upright columns 19 so supported, such molded part being formed in the embodiment shown by a center section 23' and the supporting arms 23'' engaging such section. On the top side, the center section 23' and the supporting arms 23'' are fitted with plug attachments 16 for the segments 19' of the upright column and, on their bottom sides, with recesses receiving the closed ends of the segments 19' of the upright column. By plugging the molded parts 23 to the free ends of the upright columns, the latter are fixed parallel with one another with a spacing inbetween. The molded part 23 results in a particularly stable supporting device or support device combination. Furthermore, the connection of the base plates 15 and the arrangement of the molded part 23 prevent parts of the support device from migrating sideways, for example as toy vehicle drive on supported segments of the trackway.

It is in conformity with the invention that the molded parts 23 themselves may be set up on set-up surfaces and permit the plugging of segments 19' of the upright column by means of the plug attachments 16 in the manner of base plates. To the free ends of the segments 19' so fixed, additional molded parts 23 may be plugged selectively as end or terminal mambers of upright columns or intermediate links in such upright columns.

I claim:

1. A track supporting assembly for supporting track segments above a support surface, the tracks having a center section on which toy vehicles are driven, the track supporting assembly comprising:

a base plate structure composed of at least two base plates each having at least one recess of predetermined shape and at least one attachment element thereon for mating engagement with said recess of predetermined shape on adjacent base plates to form said base plate structure, each of said base plates including an attachment plug centrally located thereon;

a longitudinally extending column supported on at least one of said base plates and formed of a plurality of column segments having a plug attachment means at a first end thereof and a mating plug attachment receiving means at a second end thereof for plugging said column segments into one another and forming said longitudinally extending column, an end column segment of said longitudinally extending column having said plug receiving means at said second end thereof detachably connected to said attachment plug on one of said base plates to provide said support for said longitudinally extending column;

a support member supported on an end of said longitudinally extending column formed by said column segments opposite said end column segment detachably connected to said attachment plug on said base plate, said support member having a plug attachment means centrally located thereon generally aligned with an attachment plug on said base plate;

at least one support arm extending radially outwardly from said support member, said radially extending support arm having an attachment plug located thereon a predetermined radial distance from said plug attachment means centrally located on said support member so that said attachment plug on said radially extending support arm is generally vertically aligned with a attachment plug on a base plate of said base plate structure; and a track support member coupled to said radially extending support arm.

2. The track supporting assembly set forth in claim 1, wherein each of said at least two base plates composing said base plate structure supports a longitudinally extending column formed of said column segments and detachably connected to said attachment plug centrally located on each base plate.

3. The track supporting assembly as set forth in claim 1, wherein said track support member includes a hooked portion inserted into and suspended from holes in said support arm.

4. The track supporting assembly as set forth in claim 1, wherein each of said plurality of column segments further include means for supporting said track support member thereon.

5. The track supporting assembly as set forth in claim 1, wherein said attachment plug comprises a longitudinally extending male element having a cross section corresponding to a predetermined cross section of said column segment and adapted to be received within a mating female element forming part of said plug attachment receiving means, said male element having a stop surface extending in a direction generally perpendicular to the longitudinal direction of said longitudinally extending column, said female element having an end engaging said stop surface.

6. The track supporting assembly as set forth in claim 5, wherein said predetermined cross section of said plurality of column segments is a rectangle with rounded corners.

7. The track supporting assembly as set forth in claim 5, wherein said predetermined cross section of said plurality of column segments is circular.

8. The track supporting assembly as set forth in claim 1, wherein each of said plurality of column segments are of identical length.

9. The track supporting assembly as set forth in claim 1, wherein each of said plurality of column segments are of different lengths.

10. The track supporting assembly as set forth in claim 1, wherein said attachment plug on said base plate is a male member and said plug attachment receiving means on said second end of said end column segment is a female member adapted to mate with said male member on said baseplate.

11. The track support assembly as set forth in claim 1, wherein said base plate and said plurality of column segments are formed of a plastically deformable material of predetermined color.

12. The track assembly as set forth in claim 1, wherein said base plate has a hexagon shape with a recess and an attachment element alternately being located on each side of said hexagonal shaped base plate.

13. The track assembly as set forth in claim 1, wherein said predetermined shape of said recess and at least one attachment element have a dovetail configuration.

14. The track supporting assembly as set forth in claim 1, wherein each column segment has a hollow interior and said first end of each of said plurality of column segments is closed and said second end of said column segment is open to said hollow interior, said first and second ends of said column segments having a predetermined cross section whereby said first end of said column segment is insertable into said hollow interior at said second end of an adjacent column segment, said first end of each of said column segments having a stop surface extending around an outer circumference defined by said predetermined cross section engaging an end of a wall forming said hollow interior of said second end.

15. A track supporting assembly for supporting track segments above a support surface, the tracks having a center section on which toy vehicles are driven, the track supporting assembly comprising:

a base plate structure composed of at least two base plates each having at least one recess of predetermined shape and at least one attachment element thereon for mating engagement with said recess of predetermined shape on adjacent base plates to form said base plate structure, each of said base plates including an attachment plug centrally located thereon;

a longitudinally extending column supported on at least one of said base plates and formed of a plurality of column segments having a plug attachment means at a first end thereof and a mating plug attachment receiving means at a second end thereof for plugging said column segments into one another and forming said longitudinally extending column, an end column segment of said longitudinally extending column having said plug receiving means at said second end thereof detachably connected to said attachment plug on one of said base plates to provide the support for said longitudinally extending column;

a support member supported on an end of said longitudinally extending column formed by said column segments opposite said end column segment detachably connected to said attachment plug on said base plate, said support member including at least one support arm extending radially outwardly therefrom said attachment plug on said base plate and said plug attachment means on said column segments having a cylindrical male element having a circular cross-section and having a plurality of clamping strips on an outer circumferential surface thereof, said clamping strips extending radially outwardly from an outer circumference of said cylindrical male element a predetermined distance and at predetermined equal angles around said circumferential surface, said plug receiving means on each of said column segments including a cylindrical hollow female portion having a predetermined circular cross-section for tightly receiving said radially outwardly extending clamping strips on said cylindrical male element.

16. A track supporting assembly for supporting track segments above a support surface, the tracks having a center section on which toy vehicles are driven, the track supporting assembly comprising:

a base plate structure composed of at least two base plates each having at least one recess of predetermined shape and at least one attachment element thereon for mating engagement with said recess of predetermined shape on adjacent base plates to form said base plates structure, each of said base plates including an attachment plug centrally located thereon;

a longitudinally extending column supported on at least one of said base plates and formed of a plurality of column segments having a circular cross section having a plug attachment means at a first end thereof and a mating plug attachment receiving means at a second end thereof for plugging said column segments into one another and forming said longitudinally extending column, said column having an end column segment having said plug receiving means at said second end thereof detachably connected to said attachment plug on one of said base plates to provide said support for said column; and a support member supported on an end of said longitudinally extending column formed by said column segments opposite said end column segment detachably connected to said attachment plug on said base plate, said support member including at least one support arm extending radially outwardly therefrom, said support arm having a U-shaped hook element at a first end thereof, each of said column segments having at least one notched receptacle means therein spaced around a circumference of said circular column segment for receiving said U-shaped hook element on said support arm.

17. The track support assembly set forth in claim 16, wherein said support arm has a second end, both said first and said second end having said U-shaped hook element.

18. The track support assembly as set forth in claim 17, wherein said first and second ends of said support arm includes an upwardly extending guide element for engaging and aligning the track segments.

19. The track support assembly as set forth in claim 16, wherein said support arm includes an upwardly extending plug element for insertion into a guide receptacle in each of the track segments.

20. The track support assembly as set forth in claim 16, wherein the track segments have an upwardly extending guide with a top surface thereon and said support arm includes at least two upwardly extending resilient strip elements each of said strip elements having hook elements extending inwardly from a free end thereof, resiliently engaging said top surface of said guide.

21. The track support assembly as set forth in claim 20, wherein said support arm include a pair of spaced, upwardly extending attachment elements for engaging openings in a bottom of said upwardly extending guide on the track segment.

22. The track assembly as set forth in claim 16, wherein said plurality of column segments have varying lengths.

* * * * *

UNITED STATES PATENT OFFICE

CERTIFICATE OF CORRECTION

Patent No. 4,826,076 Dated May 2, 1989

Inventor(s) Kurt HESSE

It is certified that error appears in the above-identified patent and that said Letters Patent is hereby corrected as shown below:

The sheets of Drawings consisting of Figures 3-15 should be added as per attached sheets.

Signed and Sealed this

Fifteenth Day of May, 1990

*Attest:*

HARRY F. MANBECK, JR.

*Attesting Officer*

*Commissioner of Patents and Trademarks*